United States Patent [19]

Carrie

[11] 4,046,056

[45] Sept. 6, 1977

[54] PNEUMATIC GUN SYSTEM AND METHOD

[75] Inventor: George W. Carrie, Scottsdale, Ariz.

[73] Assignee: The Garrett Corporation, Los Angeles, Calif.

[21] Appl. No.: 673,790

[22] Filed: Apr. 5, 1976

[51] Int. Cl.[2] ..... F41D 7/02

[52] U.S. Cl. ..... 89/12; 89/1 K; 89/126

[58] Field of Search ..... 89/12, 13 R, 1 K, 126

[56] References Cited

U.S. PATENT DOCUMENTS

| | | | |
|---|---|---|---|
| 598,822 | 2/1898 | Simpson | 89/126 |
| 2,355,179 | 8/1944 | Pontius | 89/1 K |
| 2,989,900 | 6/1961 | Grover | 89/12 |
| 3,017,807 | 1/1962 | Grover | 89/12 |
| 3,143,922 | 8/1964 | Altschuler et al. | 89/12 |
| 3,568,563 | 3/1971 | Folson | 89/126 |

*Primary Examiner*—David H. Brown

*Attorney, Agent, or Firm*—James W. McFarland; Albert J. Miller

[57] ABSTRACT

A rotary pneumatic motor provides initial acceleration and starting of a rapid firing gatling-type gun, and also provides motive drive power for the gun in another embodiment. Upon reaching operating speed, a fluidic control system modulates application of a disc brake and/or meters fluid flow to the rotary motor to maintain a constant preselected firing rate. After completion of gun firing, the rotary motor briefly drives the gun to clear the chambers of ammunition.

24 Claims, 6 Drawing Figures

PNEUMATIC GUN SYSTEM AND METHOD

BACKGROUND OF THE INVENTION

This invention relates to gas operated, automatic gatling-type guns, and relates more particularly to a pneumatic drive and/or control system therefor.

Gatling-type guns of the type referred to include an annular array of barrels carried in a common assembly which rotates to cause serial loading and firing of each barrel. Prior art examples of such weaponry may be found in the U.S. Pat. Nos. 2,849,921 of Otto; 2,989,900 of Grover; 3,331,284 of Case et al; 3,568,563 of Folson; and 3,886,843 of Hoffmann et al.

In certain arrangements such as the Folson U.S. Pat. No. 3,568,563 reference noted above, the gun is driven during normal firing operation by expanding exhaust gas channeled from the firing chambers to drive a reciprocating, intermittent motion vane motor such that gun operation is essentially self-sustaining once starting has been initiated. In such arrangements an external power source is utilized to effect initial acceleration and starting of the gun. Such prior art starting arrangements include electric motors or hydraulic systems which impose a substantial weight penalty upon the gun. Particularly in environments such as aircraft, the weight imposed by such electrical or hydraulic systems along with a relatively high sensitivity to the surrounding environmental conditions of extreme temperatures and pressures impose substantial problems and limitations.

Further, in the self-sustaining gatling gun drive described above as well as other types of gatling guns, the gun control system imposes similar penalties upon the entire gun, especially in aircraft environments. Prior art pneumatic systems utilized in conjunction with gatling-type guns, such as described in the above noted Hoffmann U.S. Pat. No. 3,886,843 are relatively complicated requiring a substantial number of pneumatic logic elements, and are generally unsatisfactory due to their complexity. Such prior art pneumatic systems characteristically utilize reciprocating pneumatic power motors, which requirement introduces substantial complexity into the control system.

SUMMARY OF THE INVENTION

Accordingly, it is a broad object of the present invention to provide a pneumatic gun system and method for gatling-type guns which substantially reduces the overall weight of the gun and renders it far less sensitive to external, extreme environmental conditions.

Another more particular object of the present invention is to provide a pneumatic gun system and method which utilizes a substantially continuously rotating pneumatic gear motor for effecting initial starting and/or driving of the gun by virtue of pressurized gas delivered thereto from a source external to the gun to thereby present a pneumatic system simply and easily controlled with a minimum of number of elements to reduce overall weight of the gun.

Another object of the invention is to provide in such a gun system and method a fluidic control system for adjusting speed of the gun to different, preselected levels to provide a reliable, lightweight gun control system.

Another particular object of the invention is to provide in a pneumatic gun system and method as described above, a clearing system for pneumatically reversing gun rotation upon completion of firing operation in order to clear the gun firing chambers of ammunition.

These and more particular objects and advantages of the present invention are specifically set forth in or will become apparent from the following detailed description of preferred arrangements of the invention, when read in conjunction with the accompanying drawings.

DETAILED DESCRIPTION OF THE PREFERRED EMBODIMENTS

Figure 1:
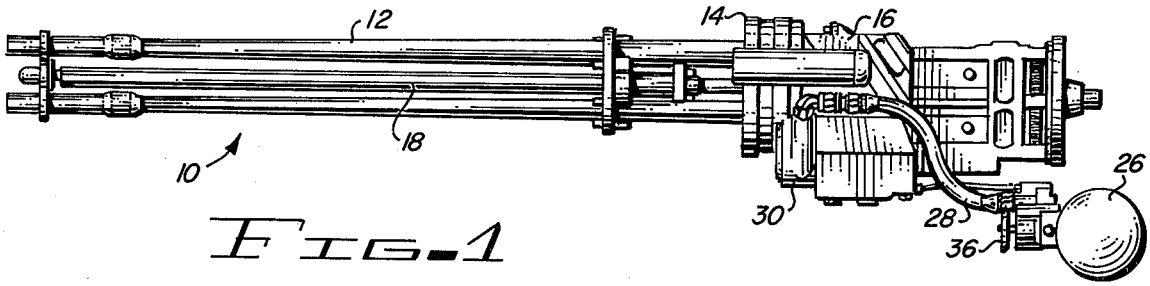
FIG. 1 is a plan view of a gatling-type gun incorporating the present invention.
Figure 2:
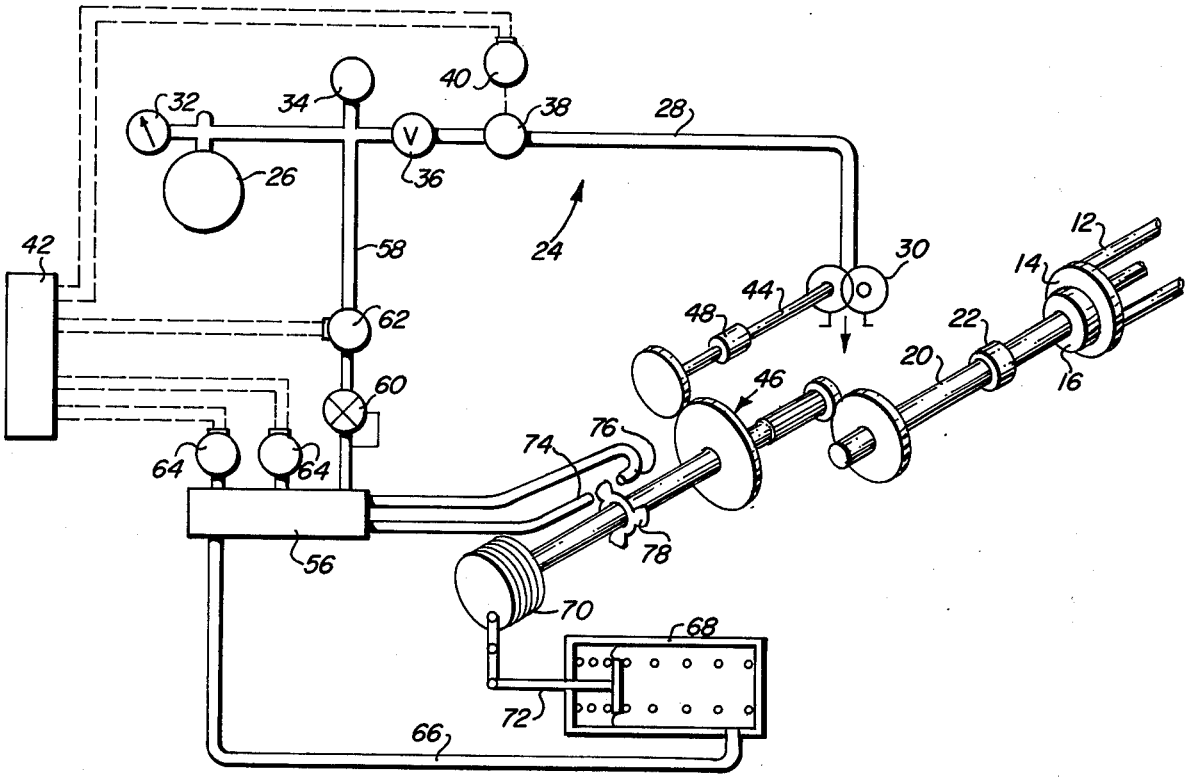
FIG. 2 is a schematic representation of one pneumatic gun system as contemplated by the present invention which effects initial starting and speed control of the gun.

Referring now more particularly to FIG. 1, a gatling-type gun of the type referred to is generally denoted by the numeral 10. The one illustrated is similar to that described in the above-referenced U.S. Pat. No. 3,568,563 to which reference may be made for a more complete description of the detailed operation of the gun itself although not necessary to the full understanding of the present invention. Briefly, a gun 10 incorporates a plurality of gun barrels 12 having corresponding firing chambers therewithin, which barrels are arranged in an annular cluster and carried in a common assembly 14 rotatable about a central longitudinal axis of the gun. The assembly 14 is driven in intermittent, rotary motion mechanism 16 which, in accordance with above-referenced U.S. Pat. No. 3,568,563 may include a central torque tube 18 and an internal, reciprocal type vane motor that utilizes exhaust gas from the gun firing chambers to create the intermittent driving of assembly 14 that brings each firing chamber sequentially into firing position. As illustrated in FIG. 2, the gun further is provided with a power input shaft 20 which operates through a schematically illustrated transmission 22 to deliver power to the intermittent motion mechanism 16 that in turn drives the assembly 14. The transmission 22 and mechansim 16 may be considered together as a transmission means for intermittently driving the assembly 14 from a substantially continuous rotation of power input shaft 20. Such arrangements of transmission means are well known in the art and are illustrated schematically herein simply for reference purposes.

As shown in FIG. 2, the invention contemplates a pneumatic starting system 24 for the gatling-type gun, which system 24 includes a source of pressurized gas 26 located remotely from the gun, a conduit 28 for delivering pressurized gas from the source to a rotary pneumatic gear-type motor 30. Communicating with conduit 28 is a pressure gauge 32, a vent and fill valve 34, a manual shut-off valve 36, and a flow shut-off or interrupting valve 38 which is operated by a corresponding electrical solenoid actuator 40. Solenoid 40 is energized by an appropriate electrical power source and control illustrated in schematic form at 42. A power output shaft 44 from the pneumatic motor 30 is operably coupled to gun power input shaft 20 through appropriate gearing 46. Interposed between the motor output shaft 44 and gun input shaft 20 is an over-running clutch 48 which prevents reverse drive of the motor 30 by rotation of input shaft 20.

Figure 4:
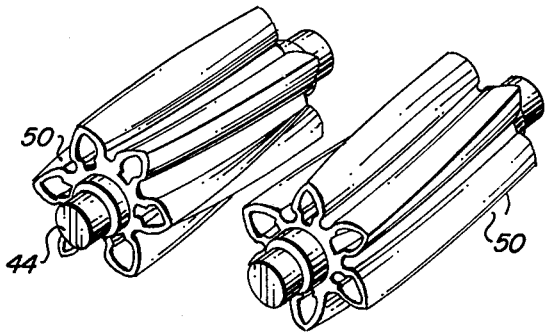
FIG. 4 is a perspective view of the intermeshing helical gears of the rotary pneumatic motor utilized in the present invention.
Figure 5:
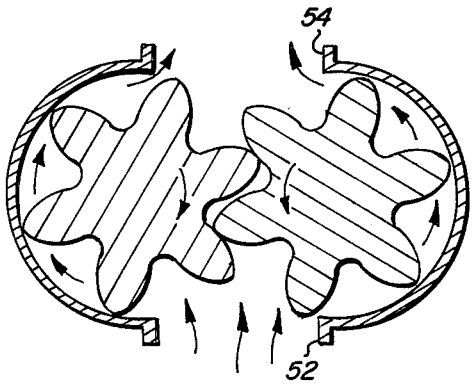
FIG. 5 is a schematic plan view showing the operating principle of the pneumatic gear motor.

As more particularly illustrated in FIGS. 4 and 5, the pneumatic motor 30 includes a pair of intermeshing gears 50 which are helically configured along their axial length to reduce torque ripple and provide smooth system operation. Each of the gears has a plurality of involute profile teeth which are hollowed substantially throughout to minimize weight of the motor. As schematically shown in FIG. 5, flow of relatively high pressure input gas through inlet 52 causes rotation of the intermeshing gears 50, the gas being carried in the intertooth spaces to a low pressure exhaust 54.

The system illustrated in FIG. 2 also includes a fluidic speed control system which comprises a fluidic logic block 56 receiving pressurized gas from source 26 through conduit 58 and a pressure regulating valve 60 of conventional structure which regulates pressure of gas flow to the fluidic module 56 to a substantially constant level lower than pressure of gas stored in source 26. A safety arming solenoid flow shutoff valve 62 is interposed in conduit 58 to permit flow of regulated pressure gas to the fluidic module only upon energization of the solenoid of valve 62.

The fluidic module further includes a plurality of electrically operated solenoid valves 64 for step-wise adjustment of the constant firing rate of the gun. An output pressure signal from the fluidic module is transmitted through conduit 66 to a pneumatic piston-cylinder type actuator 68 whose cylinder is connected through appropriate mechanical linkage with a disc-type brake 70 operably coupled to the gun input shaft 20 through gearing 46. Brake 70 is arranged to be "normally on" to inhibit rotation of shaft 20. As pressure delivered from conduit 66 to actuator 68 increases, the piston and rod arrangement 72 is shifted leftwardly to gradually release brake 70. Accordingly, by modulation of pressure delivered to actuator 68, brake 70 regulates speed of rotation of input shaft 20. Through gas emitting and receiving nozzles 74 and 76, the speed of rotation of shaft 20 is sensed as flow interrupter 78 rotates to produce a pulsating gas flow in nozzle 76 of a frequency substantially greater than but related to shaft speed.

Figure 3:
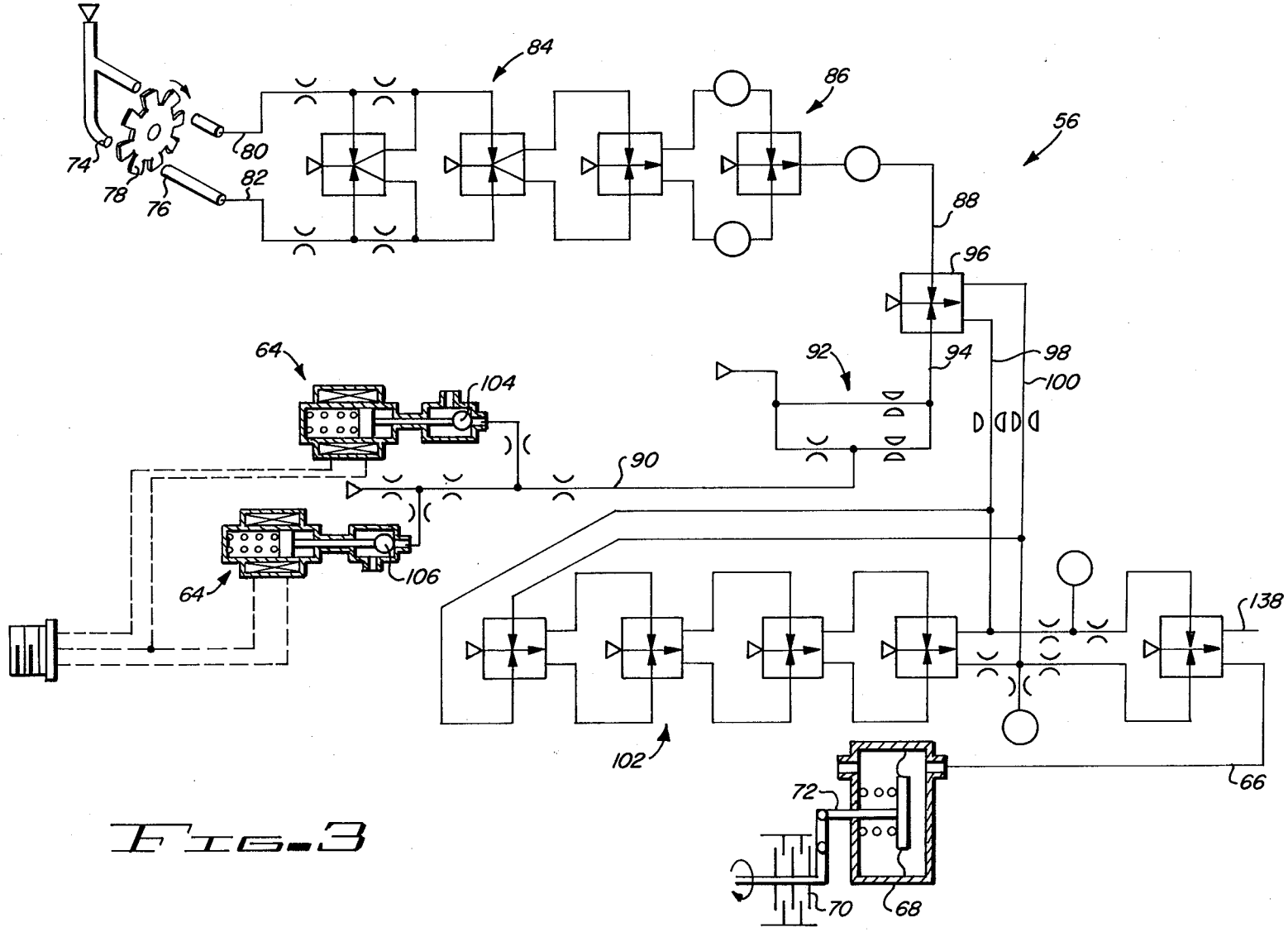
FIG. 3 is a schematic representation of the fluidic speed control system as contemplated by the present invention.

Referring more particularly to FIG. 3, the fluidic system is illustrated in schematic form utilizing conventional fluidic circuitry symbols generally corresponding to symbols set forth in "Military Standard Fluerics Terminology and Symbols", MIL-STD-1306A, Dec. 8, 1972, Department of Defense, Washington, D.C. 20301. Rotation of flow interrupter 78 generates a pulsating, pressure signal in lines 80 and 82 that is fed to a pulse shaper and amplifier circuitry 84 and to a frequency to analog converter circuitry 86 to present a signal in line 88 whose pressure varies proportionately in relation to the frequency of the pulse generator and thus proportional to speed of the gun shaft 20. From the regulated pressure source through line 90 and a temperature compensating circuit 92 there is delivered to line 94 a reference pressure signal whose pressure level is indicative of the desired, selected speed of rotation of the gun. Through a fluidic amplifier 96, the pressure signals in lines 88 and 94 are compared, and an output pressure error signal proportional to the difference therebetween is developed across lines 98 and 100. The error signal carried in lines 98 and 100 is passed through a dynamic compensation circuitry 102 which also operates as a power amplifier to develop a pneumatic power output signal in line 66 whose pressure level varies in relation to the fluidic error signal in lines 98 and 100. A more detailed description of the fluidic pulse shaper and amplifier circuit 84, frequency to analog converter circuitry 86, and dynamic compensation circuitry 102 may be found in U.S. Pat. No. 3,696,895 of Schaffer et al. To the extent necessary for a complete understanding of the present invention reference may be made to the aboveidentified Schaffer patent. Various other fluidic circuitry may be utilized in place of that illustrated in FIG. 3, such being only one example of such a circuit which can compare a sensed speed with a reference speed level and develop a pressure output signal in relation to the error between the actual and desired speeds.

The reference pressure level in line 94 may be selectively modified so as to provide a step change capability in gun firing rate. To this end, the speed-determining solenoid operated valves 64 each include poppet valves 104 and 106 which communicate with line 90. Both solenoids are normally in the closed position illustrated when not energized, and upon energization of each of the solenoids, the associated poppets 104, 106 are retracted from their associated fluid sealing seats to present open paths to the atmosphere. In this manner, for instance, actuation of only one solenoid 64 to retract poppet 104 reduces the pressure level in line 94 to a level dictating a lower gun firing rate, while energization of both solenoids to open both of the poppets 104 and 106 further reduces pressure in line 94 to yet further reduce desired gun rate.

In operation of the system illustrated in FIG. 2, an "arming" command signal energizes arming valve 62 to permit pressure fluid flow to the fluidic module 56. Regulator 60 assures a relatively low, constant pressure flow to the fluidic system. The regulated pressure flow for the fluidic system is on the range of approximately 7 to 10 psi above ambient pressure, whereas pressure of gas stored in source 26 is substantially greater, approximately several hundred psi above ambient. A gun actuation or firing command signal actuates solenoid 40 to open shut-off valve 38 to permit relatively high pressure fluid flow through conduit 28 to effect rotation of motor 30 and relatively rapid acceleration of the input drive shaft 20 and rotation of the gatling gun 10. In less than one second, the starting system accelerates the gun to near rated speed so that gun firing is initiated while the starting system is still in operation. Once gun firing is initiated, the gas discharged from the firing chambers operates the intermittent motion mechanism as specifically discussed in the above-referenced U.S. Pat. No. 3,568,563 to continue normal gun drive operation. Once gun driving is being accomplished by mechanism 16, solenoid 40 is de-energized and valve 38 moves to a closed position to avoid unnecessary loss of pressurized gas from source 26. The one way clutch 48 is operable to prevent reverse back drive of the motor 30 as the shaft 20 is rotated by mechanism 16 during normal gun drive and firing.

The fluidic control system is operable to control gun firing speed to a preselected level by modulating pressure delivered through line 66 to actuator 68 to vary the application of disc brakes 70 as more specifically described above. The rate of gun firing is selected by energizing none, one or both of speed solenoids 64. With neither solenoid 64 energized, both poppets 104 and 106 are in a closed position as illustrated in FIG. 3 and a relatively high reference pressure signal delivered to line 94. As a result the fluidic system modulates and controls gun speed to a relatively high, but constant rate. If actual speed is less than that selected, pressure in line 88 is greater than in line 94, resulting in greater pressure in line 98 and a reduction in output signal pressure in 66 to apply the brake and reduce speed. Reverse action occurs if actual speed is less than the selected speed. Upon actuating the upper solenoid in FIG. 3 to open poppet 104, pressure in line 94 reduces and the fluidic control system is effective to regulate gun firing rate to an intermediate, lower rate. With energization of both solenoids 64 to exhaust flow paths from line 90, the reference pressure in line 94 is at a substantially low level, and the fluidic system accordingly regulates gun rate to its lowest preselected, constant rate. Accordingly, it will be seen that the FIG. 2 arrangement provides a lightweight, effective system for rapidly initially accelerating the gun and for controlling gun speed without introduction of costly, heavy, flywheel energy storage arrangements or other complicated, expensive and relatively heavy devices characteristic of prior art arrangements.

Figure 6:
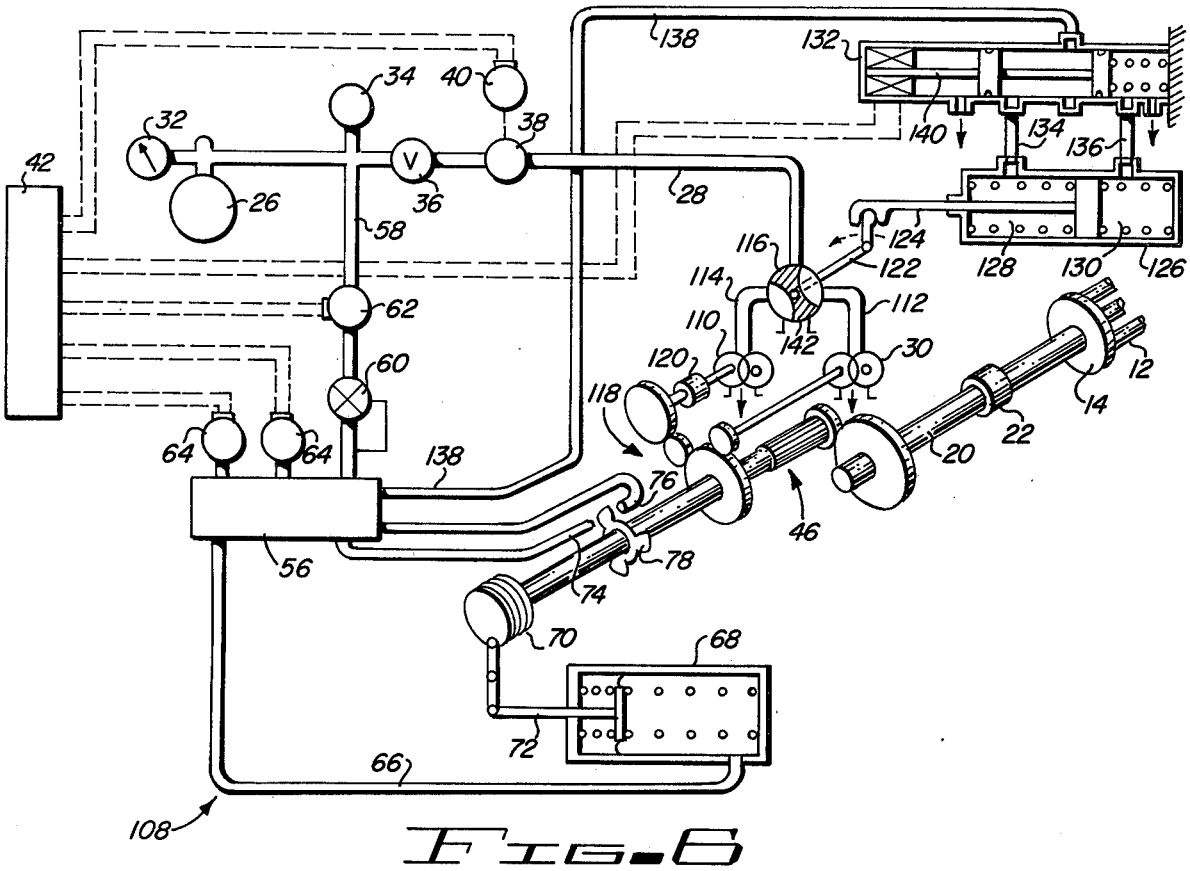
FIG. 6 is a schematic representation similar to FIG. 2 but showing a pneumatic gun system arrangement which effects initial starting, driving, speed control and reverse clearing of the gatling-type gun.

A slightly modified pneumatic system 108 is illustrated in FIG. 6 which not only accomplishes gun starting and speed control as the FIG. 2 arrangement, but also drives the gun throughout its firing operation and also effects reversing or clearing of the gun of live ammunition rounds subsequent to completion of gun firing. As denoted by the use of like reference numerals, the system in FIG. 6 incorporates a substantial number of the components also shown in the FIG. 2 arrangement.

The FIG. 6 system further includes an additional gear motor 110 having helical, hollowed, intermeshing gears of involute profile similar to that illustrated in FIGS. 4 and 5. Conduit 28 branches into subconduits 112 and 114 respectively delivering pressurized gas to the two motors 30 and 110. A rotary type directional flow control valve 116 is shiftable between the position illustrated wherein pressurized gas is delivered to rotate motor 30, and a second position communicating conduit 28 and 114 to effect driving of motor 110. Motor 30 is the primary drive motor and is effectively coupled through gearing 46 with the drive shaft 20. Motor 110 drives through additional gearing 118 so as to rotate shaft 20 in a reverse direction relative to the direction of rotation of shaft 20 by motor 30. A clutch mechanism 120 is interposed between motor 110 and shaft 20 while no clutch is interposed between the other motor 30 and the shaft. System 108 does not include the internal gas drive associated with mechanism 16 of FIG. 2. Instead, transmission means 22 is operative to translate the continuous rotary motion of shaft 20 into the intermittent drive motion required for assembly 14.

Through appropriate handle linkage 122, linear displacement of the rod and piston arrangement 124 of a second pneumatic actuator causes rotary shifting of valve 116 between the above-described two positions. The piston and rod arrangement is disposed in a cylinder 126 defining a pair of opposed chambers 128 and 130 on opposite sides of the piston. A solenoid-operated directional control valve 132 has output ports communicating through conduits 134 and 136 respectively with chambers 128 and 130. Valve 132 further has a pressure fluid input port receiving pressurized gas from fluidic module 56 through conduit 138. In the position illustrated control valve 132 directs pressurized gas from conduit 138 through conduit 134 into chamber 128 to position rotary valve 116 as illustrated so that pressurized gas from source 26 is delivered to motor 30 to effect forward driving during normal firing operation. Energization of the solenoid valve 132 shifts its flow directing spool 140 rightwardly to accomplish interconnection of conduit 138 with chamber 130 while venting the other chamber 128. In this latter condition, the piston and cylinder arrangement 124 is urged leftwardly to rotate valve 116 toward the position directing pressurized gas from conduit 128 to drive the reverse motor 110, and conduit 112 communicates with a vent 142 to relieve back pressure from the other motor 30.

The fluidic control system is again that illustrated in FIG. 3 with the exception that the output signal line 138, instead of being vented as in the FIG. 2 arrangement, now supplies a pressure signal to the second actuator to adjust the position of rotary valve 116. Opposite to the pressure signal carried in line 66, the pressure signal in line 138 increases as shaft speed surpasses the selected, desired speed, and produces lower pressure signal whenever shaft speed is below desired level. The magnitude of the pressure signal in line 138 is transmitted to chamber 128 during gun driving operation to incrementally position rotary valve 116 and effect metering of fluid flow to the drive motor 30 to assist brake 70 in regulating gun speed.

In operation of the FIG. 6 arrangement, the arming command again energizes solenoid operated valve 62 so that relatively low, constant, regulated air flow is delivered to the fluidic system. A command firing signal then energizes solenoid 40 to open shutoff valve 38 and allow delivery of motive gas flow through conduit 28 to drive motor 30. In this condition, the solenoid of directional valve 132 is de-energized so that pressure is delivered to chamber 128 to position rotary valve in its forward drive position illustrated. Accordingly, the motive gas flow effects rotation of motor 30 and thus the input shaft 20 of the gun. The gun again rapidly accelerates and firing is initiated similar to the action described with respect to FIG. 2. In contrast to the FIG. 2 arrangement, however, shutoff valve 38 is maintained in its open position such that motor 30 continues to effect driving of the gun throughout firing operation.

As described above with respect to the FIG. 2 system, the fluidic speed control system is effective to position the piston and rod arrangement 72 of actuator 68 to apply and/or release brake 70 and control gun firing rate. Additionally, the pressure signal in conduit 138 delivered to chamber 128 of the other actuator is effective to incrementally position rotary valve 116 to meter fluid flow to motor 30. Thus, for instance in the situation of excessive shaft speed above that selected in relation to energization of none, one or both of the speed solenoids 64, rotary valve 116 is rotated slightly clockwise to reduce fluid flow to motor 30 and thus reduce shaft speed back to the desired level. The incremental positioning and metering accomplished by rotary valve 116 acts substantially as a trim speed control such that application of brake 70 is minimized. In this manner the energy losses through application of brake 70 are minimized while shaft speed is continually regulated to the desired set point speed. As will be readily recognized to those skilled in the art, dependent upon the relative dynamic operational characteristics of actuator 68 in comparison with the other actuator controlling rotary valve 116, the fluidic control system illustrated in FIG. 3 may incorporate a second dynamic compensation network (not shown) between the lines 98, 100 and output line 138.

Throughout gun firing operation, the fluidic control system, by virtue of modulating the application of brake 70 and modulating the position of rotary valve 116, maintains the desired speed level of the gun. Once gun firing has been completed the solenoid of reversing valve 132 is energized to shift its spool 140 rightwardly such that pressurized gas in chamber 138 is directed to the other chamber 130. Rotary valve 116 rotates counter clockwise to effect communication of conduit 28 with subconduit 114 and consequent driving rotation of motor 110. Through gearing 118 shaft 20 is driven in a reverse direction such that the ammunition belt being fed into the gun is driven reversely and all the gun firing chambers are cleared of live ammunition. Gun clearing or reversing can be accomplished by a relatively momentary driving of motor 110 so that a very few revolutions of shaft 20 in the reverse direction completely clears the gun of live ammunition. During this reverse gun clearing operation, motor 30 is driven reversely; however, the communication of subconduit 112 with vent 142 avoids development of back pressure on motor 30 which would inhibit rotation of the gear train. In contrast, it will be noted that during normal forward driving of the gun through rotation of motor 30, the overriding clutch 120 prevents unnecessary reverse driving of the other motor 110.

From the foregoing it will be apparent that the present invention also contemplates an improved method of operating a rapid firing gatling-type gun which includes pneumatically starting and driving the gun during normal firing operation by supplying pressurized gas to a pneumatic gear motor 30. During gun firing a fluidic signal indicative of speed of rotation of the drive shaft of the gun is generated and fluidically compared to a fluidic reference signal indicative of a selected, desired speed of gun operation. An output fluidic error signal in line 66 and/or 138 is utilized to adjust speed of rotation of the gun input shaft to maintain gun firing rate at the preselected level. Gun firing is stopped by interrupting supply of gas flow to the first air motor, and clearing the gun of ammunition at completion of gun firing is further accomplished by directing the pressurized gas to the other gear motor 130 that drives the gun in a reverse direction.

Various modifications and alterations to the above-described systems will be apparent to those skilled in the art. Accordingly, the foregoing detailed description of preferred arrangements of the invention should be considered exemplary in nature and not as limiting to the scope and spirit of the invention as set forth in the appended claims.

Having described the invention with sufficient clarity that those skilled in the art may make and use it, I claim:

1. In combination with a gatling gun having a plurality of firing chambers, a substantially continuously rotating power drive shaft, intermittent motion means capable of being driven by said shaft for intermittently rotating said chambers sequentially into firing position, and drive means supplied with gas exhausted from said chambers and effective to drive said intermittent motion means after firing has been initiated; a starting system for effecting initial rotation and acceleration of said shaft and firing of said gun, comprising:

a continuously rotatable pneumatic motor separate from said drive means and disposed in driving relationship with said shaft;

a source of pressurized gas disposed remotely from said gun;

conduit means communicating said source with said motor; and a solenoid operated flow shut-off valve disposed in said conduit means in a normally closed position blocking flow to said motor, said valve shiftable to an open position for permitting delivery of pressurized gas from said source to energize said motor and effect initial rotation and acceleration of said shaft and firing of said gun.

2. A combination as set forth in claim 1, wherein said motor comprises a pneumatically actuated gear motor having a pair of intermeshing gears of involute profile.

3. In combination with a gatling gun having a plurality of firing chambers, a substantially continuously rotating power drive shaft, intermittent motion means capable of being driven by said shaft for intermittently rotating said chambers sequentially into firing position, and drive means supplied with gas exhausted from said chambers and effective to drive said intermittent motion means after firing has been initiated; a starting system for effecting initial rotation and acceleration of said shaft and firing of said gun, comprising:

a continuously rotatable pneumatic motor separate from said drive means and disposed in driving relationship with said shaft;

a source of pressurized gas disposed remotely from said gun;

conduit means communicating said source with said motor;

control means operably associated with said conduit means for permitting delivery of pressurized gas from said source to energize said motor and effect initial rotation and acceleration of said shaft and firing of said gun;

pneumatically operated regulating means operably associated with said shaft for controlling speed thereof subsequent to said starting thereof; and fluidic control means for sensing speed of said shaft and actuating said regulating means to maintain said shaft speed at a substantially constant preselected level.

4. In combination with a gatling gun having a plurality of firing chambers, a substantially continuously rotating power drive shaft, intermittent motion means capable of being driven by said shaft for intermittently rotating said chambers sequentially into firing position, and drive means supplied with gas exhausted from said chambers and effective to drive said intermittent motion means after firing has been initiated; a starting system for effecting initial rotation and acceleration of said shaft and firing of said gun, comprising:

a continuously rotatable pneumatic motor separate from said drive means and disposed in driving relationship with said shaft, said motor comprising a pneumatically actuated gear motor having a pair of intermeshing gears of involute profile;

a source of pressurized gas disposed remotely from said gun;

control means operably associated with said conduit means for permitting delivery of pressurized gas from said source to energize said motor and effect initial rotation and acceleration of said shaft and firing of said gun, said control means including a solenoid operated flow shut-off valve disposed in said conduit means, said valve arranged in a normally closed position blocking flow to said gear motor, said valve shiftable to an open position for effecting said initial rotation upon energization of said solenoid thereof.

5. A combination as set forth in claim 4, further including clutch means disposed between said motor and said shaft for preventing driving of said motor by said shaft subsequent to said initial rotation.

6. In combination with a gatling gun having a rotatable assembly of a plurality of firing chambers for receiving ammunition rounds, and a substantially continuously rotatable shaft disposed in power transmitting relationship with said assembly and rotatable in a first direction during gun firing; a pneumatic clearing system for selectively clearing said gun of ammunition rounds, comprising:

a source of pressurized gas disposed remotely from said gun;

continuously rotatable pneumatic motor means communicating with said source to receive pressurized gas therefrom, said motor means operably coupled with said shaft whereby said motor means produces at least a portion of the power for rotating said assembly; and directional fluid control valve means for selectively directing pressurized gas to said motor means to drive said shaft and assembly in a second, reverse direction to effect said clearing.

7. A combination as set forth in claim 6, wherein said motor means includes a pneumatically actuated gear motor having intermeshing helical gears.

8. A combination as set forth in claim 7, wherein said motor means includes first and second gear motors, each having hollowed intermeshing helical gears of involute profile, said first and second motors respectively coupled with said shaft to drive the latter in said first and second directions.

9. A combination as set forth in claim 8 further including clutch means disposed between second motor and said shaft for preventing driving of said second motor by said shaft while the latter is driven in said first direction by said first motor.

10. A combination as set forth in claim 9, wherein said control valve means includes a directional control rotary valve disposed between said source and said motors, and a pneumatic actuator receiving pressurized gas from said source and operably coupled with said rotary valve to shift the latter between first and second positions respectively directing pressurized gas flow to said first and second motors.

11. A combination as set forth in claim 10 wherein said control valve means further includes a solenoid operated directional flow control valve disposed between said source and said actuator for selectively directing pressurized gas to opposite sides of said actuator to shift said rotary valve.

12. In combination with a gatling gun having a rotating firing assembly, a speed control system comprising:

sensing means for sensing the speed of rotation of said assembly and for generating a fluidic signal indicative of said speed;

regulating means operably coupled to said assembly to regulate said speed thereof;

pneumatic actuator means for actuating said regulating means;

reference means for selectively generating different fluidic reference signals indicative of different desired speeds of rotation of said assembly;

first fluidic circuitry means for comparing said fluidic speed signal and said selected desired speed signal, and generating a fluidic output error signal indicative of the difference therebetween; and second fluidic circuitry means for generating a pneumatic pressure signal energizing said actuator means in relation to said error signal whereby said speed of the assembly is regulated to a value substantial equal to the selected desired speed of rotation.

13. A combination as set forth in claim 12, further including a source of pressurized gas supplying motive flow to said speed control system and means for regulating said motive flow to a substantially constant preselected pressure, said reference means including a plurality of solenoid operated valves for selectively step-wise changing a reference pressure signal to generate said different reference signals.

14. A combination as set forth in claim 13, further including a solenoid operated arming valve shiftable between positions respectively blocking and permitting communication of said motive flow with said speed control system.

15. In combination with a gatling gun having a plurality of firing chambers, a power input shaft, and means driven by said shaft for intermittently rotating said chambers sequentially into firing position, a pneumatic drive system comprising:

a source of pressurized gas disposed remotely from said gun;

continuously rotatable pneumatic motor means disposed in driving relationship with said shaft;

conduit means communicating said source with said motor means; and control means operably associated with said conduit means for controlling flow of pressurized gas to said motor means to regulate gun operation, said control means operable to selectively direct pressurized gas to drive said motor means and said shaft in a first direction to effect gun firing operation, and selectively operable to drive said motor means and said shaft in a second opposite direction for clearing said firing chambers subsequent to completion of gun firing.

16. A combination as set forth in claim 15, wherein said control means includes pneumatically operated regulating means operably associated with said shaft for controlling speed thereof, and fluidic control means for sensing speed of said shaft and actuating said regulating means to maintain said shaft speed at a substantially constant preselected level.

17. In combination with a gatling gun having a plurality of firing chambers, a power input shaft, and means driven by said shaft for intermittently rotating said chambers sequentially into firing position, a pneumatic drive system comprising:

a source of pressurized gas disposed remotely from said gun;

continuously rotatable pneumatic motor means disposed in driving relationship with said shaft;

conduit means communicating said source with said motor means; and control means operably associated with said conduit means for controlling flow of pressurized gas to said motor means to regulate gun operation, said control means including pneumatically operated regulating means operably associated with said shaft for controlling speed thereof, and fluidic control means for sensing speed of said shaft and actuating said regulating means to maintain said shaft speed at a substantially constant preselected level.

18. In combination with a gatling gun having a plurality of firing chambers, a power input shaft, and means driven by said shaft for intermittently rotating said chambers sequentially into firing position, a pneumatic drive system comprising:

a source of pressurized gas disposed remotely from said gun;

continuously rotatable pneumatic motor means disposed in driving relationship with said shaft;

conduit means communicating said source with said motor means; and control means operably associated with said conduit means for controlling flow of pressurized gas to said motor means to regulate gun operation, said motor means including first and second motors respectively coupled with said shaft to drive the latter in a first direction for gun firing and in a second reverse direction for clearing the gun subsequent to completion of firing.

19. A combination as set forth in claim 18, further including clutch means disposed between second motor and said shaft for preventing driving of second motor by said shaft while the latter is driven in said first direction by said first motor.

20. A combination as set forth in claim 19, wherein said control means includes a rotary valve disposed in said conduit means, a first pneumatic actuator receiving pressurized gas from said source and operably coupled with said rotary valve to shift the latter between first and second positions respectively directing pressurized gas to said first and second motors, and a solenoid operated directional flow control valve for directing pressurized gas to opposite sides of said first actuator to shift said rotary valve.

21. A combination as set forth in claim 20, further including a brake member engageable with said shaft to regulate the speed thereof, a second pneumatic actuator supplied with pressurized gas from said source for adjusting said brake means, and fluidic control means operably associated with said source, said shaft and said second actuator for sensing shaft speed and generating a variable pressure output signal to operate said second actuator to maintain said shaft speed at a substantial constant preselected level.

22. A combination as set forth in claim 21, wherein said rotary valve is variably positionable to meter pressurized gas flow to said first motor in relation to the pressure of gas delivered to said first actuator, said fluidic control means operably associated with said first actuator whereby said variable pressure output signal also operates said first actuator.

23. In combination with a gatling type gun having a rotary assembly presenting a plurality of firing chambers and a transmission operably associated with said assembly for intermittently rotating the latter, said transmission having a substantially continuously rotating power input shaft;

first and second rotary pneumatic motors separately disposed in power transmitting relationship with said shaft;

a source of pressurized gas located remotely from said gun;

conduit means communicating said source with said first and second motors;

a directional flow control valve disposed in said conduit means and shiftable between a first position directing pressurized gas to drive said first motor and said assembly in a first direction to effect gun firing, and a second position directing pressurized gas to drive said second motor and thus drive said assembly in a second opposite direction to effect gun clearing;

a first pneumatic actuator supplied with pressurized gas from said source for shifting said flow control valve;

brake means operably associated with said drive shaft for regulating the speed of rotation thereof;

a second pneumatic actuator supplied with pressurized gas from said source for adjusting said brake means to regulate said shaft speed; and fluidic control means operably associated with said source; said shaft and said second actuator for fluidically sensing shaft speed and controlling flow of pressurized gas to said second actuator to maintain said shaft speed at a substantially constant preselected level during gun firing.

24. A method of operating a rapid fire gatling type gun having a rotary assembly of firing chambers and a power input shaft, comprising the steps of:

pneumatically starting and driving said assembly to effect gun firing by supplying pressurized gas to a first, continuously rotatable pneumatic motor coupled to said power input shaft, to rotate the latter in a first gun firing direction;

generating a first fluidic signal indicative of actual speed of rotation of said shaft;

generating a second fluidic reference signal indicative of a desired shaft speed;

fluidically comparing the first and second signals and generating a fluidic error signal indicative of the difference therebetween;

adjusting shaft speed in relation to said fluidic error signal to maintain said shaft speed at the selected, desired speed during gun firing;

interrupting the supply of pressurized gas to said first motor to stop rotation of said assembly and gun firing; and clearing said gun of ammunition subsequent to completion of gun firing by directing pressurized gas to a second continuously rotatable pneumatic motor to drive said shaft and said assembly in a second opposite direction.

* * * * *